United States Patent [19]

Rhoe et al.

[11] Patent Number: 4,592,831

[45] Date of Patent: Jun. 3, 1986

[54] SOLVENT FOR REFINING OF RESIDUES

[75] Inventors: Andrei Rhoe, Wyckoff; Joseph A. Pisani, Old Bridge; Gary L. Hamilton, Little Silver; George D. Suciu, Ridgewood, all of N.J.

[73] Assignee: Lummus Crest Inc., Bloomfield, N.J.

[21] Appl. No.: 680,924

[22] Filed: Dec. 12, 1984

[51] Int. Cl.[4] ..... C10C 1/18; C10C 3/08

[52] U.S. Cl. ..... 208/309; 208/45

[58] Field of Search ..... 208/45, 309

[56] References Cited

U.S. PATENT DOCUMENTS

| | | | |
|---|---|---|---|
| 2,045,742 | 6/1936 | Winning et al. | 208/309 |
| 2,955,079 | 10/1960 | Foley | 208/45 |
| 3,003,946 | 10/1961 | Garwin | 208/45 |
| 3,079,326 | 2/1963 | Neuworth | 208/45 |
| 3,153,626 | 10/1964 | Kulik | 208/45 |
| 3,206,388 | 9/1965 | Pitchford | 208/45 |
| 3,228,870 | 1/1966 | Pitchford | 208/309 |
| 3,228,873 | 1/1966 | Youngblood et al. | 208/191 |
| 3,321,394 | 5/1967 | Mills | 208/45 |
| 3,331,789 | 7/1967 | Clark | 208/45 |
| 3,364,138 | 1/1968 | Campagne et al. | 208/45 |
| 3,414,506 | 12/1968 | Campagne et al. | 208/309 |
| 4,318,824 | 3/1982 | Turner | 208/45 |
| 4,324,651 | 4/1982 | Rollmann et al. | 208/45 |

FOREIGN PATENT DOCUMENTS

| | | | |
|---|---|---|---|
| 574460 | 1/1946 | United Kingdom | 208/45 |

*Primary Examiner*—Andrew H. Metz
*Assistant Examiner*—Helane Myers
*Attorney, Agent, or Firm*—Elliot M. Olstein

[57] ABSTRACT

Solvent refining of a residual oil is accomplished with a refining solvent containing methanol and propanol, preferably isopropanol. The solvent produces high yields of a high quality refined oil, as well as a pumpable pitch fraction.

14 Claims, 1 Drawing Figure

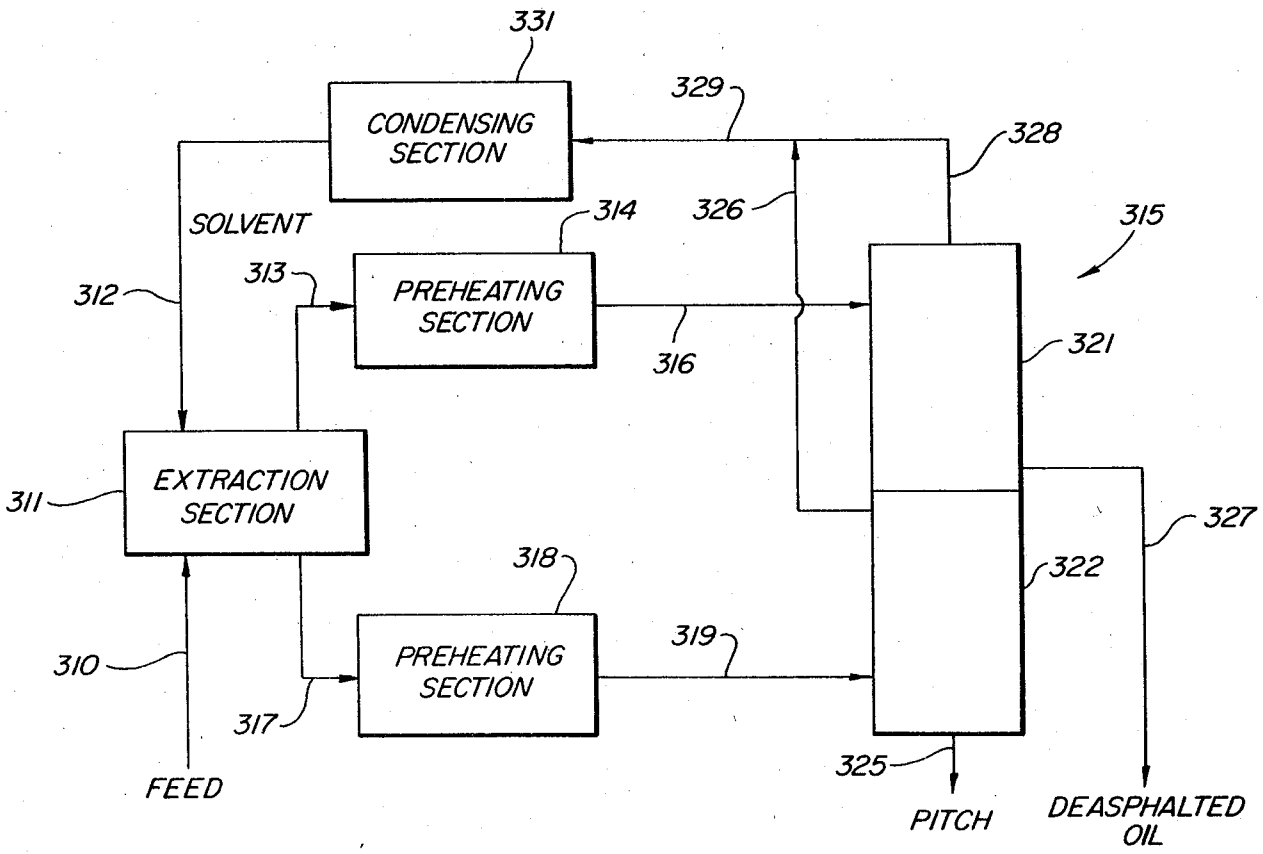
CONDENSING SECTION
PREHEATING SECTION
PREHEATING SECTION
EXTRACTION SECTION
SOLVENT
FEED
PITCH
DEASPHALTED OIL
331
329
328
315
321
322
327
326
325
316
319
314
318
313
317
312
311
310

SOLVENT FOR REFINING OF RESIDUES

This invention relates to the solvent refining of heavy fractions sometimes referred to as residues or residual oils, and more particularly to the removal of pitch-like impurities from residues, sometimes referred to as deasphalting. More particularly, this invention relates to deasphalting of residues by use of an improved solvent.

Solvent refining of residues so as to separate a refined oil from a pitch impurity is a technique generally known in the art. Thus, for example, deasphalting of residues by use of a deasphalting solvent so as to separately recover pitch and deasphalted oil is a technique generally known in the art.

A wide variety of solvents have been employed for accomplishing such deasphalting. In general, deasphalting is accomplished by use of a paraffinic hydrocarbon solvent, such as propane, butanes, pentanes and higher hydrocarbons, or mixtures thereof.

In addition, alcohols have been employed as a deasphalting solvent; e.g., U.S. Pat. No. 3,003,946; U.S. Pat. No. 3,206,388; U.S. Pat. No. 3,228,873; U.S. Pat. No. 3,364,138; U.S. Pat. No. 4,324,651; and British Pat. No. 450,511.

In most cases, deasphalting is accomplished at elevated pressures in the order of from 300 to 600 psig.

In co-pending U.S. Application Ser. No. 680,897 filed on Dec. 12, 1984, there is described a process for solvent refining which can be accomplished at low pressures. As a result of this procedure, as well as other procedures, there is a need for a solvent which can be employed for the effective solvent refining of a residue at lower pressures.

In accordance with one aspect of the present invention, there is provided a process for the solvent refining of a residue wherein such solvent refining is accomplished with a refining solvent which provides a pumpable pitch fraction at a temperature at which the solvent refining system pressure does not exceed 150 psig wherein the solvent contains both methanol and a propanol (i-propanol and/or n-propanol, preferably i-propanol).

Applicant has found that there can be achieved improved refining of residues when employing a solvent which contains methanol and propanol, and that such refining can be accomplished at low pressures. Thus, for example, the use of a combination of propanol and methanol results in a higher quality of deasphalted oil as compared to the use of propanol alone, for the same yield of deasphalted oil. This result was unexpected in that, as a result of the known anti-solvent properties of methanol, it would have been expected that the addition of methanol to propanol, in a deasphalting solvent, would lower the yield of deasphalted oil.

In addition, the use of a combination of methanol and propanol, as compared to methanol alone, permits the solvent refining to be effected at lower temperatures and pressures. More particularly, when employing methanol alone as a deasphalting solvent, in order to obtain a satisfactory yield of deasphalted oil, such deasphalting generally requires temperatures in the range of 345°–440° F., with the corresponding operating pressures being in the order of from 500–1200 psig; for example, U.S. Pat. No. 4,324,651. In using methanol alone, as a deasphalting solvent, it is not possible to effect the deasphalting at lower temperatures and pressures, while maintaining both a satisfactory yield of deasphalted oil and a continuous process for deasphalting, in that lower temperatures and pressures, at comparable yields of deasphalted oil, do not provide an asphalt fraction with the flow properties required for deasphalting in a continuous procedure; i.e., the asphalt (pitch) fraction is too hard and not readily pumpable.

In employing a refining solvent which contains methanol and propanol and which provides a pumpable pitch fraction at temperatures at which the system pressure does not exceed 150 psig, and preferably does not exceed 100 psig, the ratio of methanol to propanol can be adjusted so as to obtain the desired quality of refined oil, in the desired yield. In general, the weight ratio of methanol to propanol in the solvent is at least 1:10 and generally no greater than 1:1. The methanol to propanol weight ratio is preferably at least 1:5 and preferably no greater than 1:3. The selection of an optimum ratio of methanol to propanol so as to obtain the desired quality of refined oil in the desired yield is deemed to be within the scope of those skilled in the art from the teachings herein.

By proceeding in accordance with the present invention it is possible to employ ratios of solvent to residue which are generally lower than those which are employed when using other known deasphalting solvents for comparable yield and quality of deasphalted oil. In general, the weight ratio of solvent to feed is at least 1:1, and generally no greater than 7:1. In accordance with a preferred embodiment, the weight ratio of solvent to feed is at least 2:1, and no greater than 4:1. The selection of an optimum ratio within the hereinabove described ranges for use with a particular residue so as to obtain a desired deasphalted oil quality is deemed to be within the scope of those skilled in the art from the teachings herein. It is to be understood that ratios higher than those hereinabove described could be used; however, the higher ratios are not required in order to obtain a good yield and quality of deasphalted oil.

By employing a deasphalting solvent which contains a combination of propanol (preferably isopropanol) and methanol, it is possible to effect deasphalting of residues wherein the solvent is recovered at low pressures; i.e., at pressures of no greater than 150 psig, and preferably no greater than 100 psig while still providing a pumpable stream of recovered asphalt or pitch. Although it is possible to employ such low pressures by proceeding in accordance with the invention, as should be apparent to those skilled in the art, deasphalting may also be accomplished at pressures in excess of 100–150 psig.

The temperature which is employed for the deasphalting is a temperature such that the solvent is a liquid at the operating pressure. For pressures which do not exceed 100 psig, the operating temperature would be in the order of from 210° F. to 340° F. It is possible to employ higher temperatures; however, when using such elevated temperatures, correspondingly higher pressures must also be employed; for example, temperatures up to about 360° F. require pressures up to 310 psig.

In accordance with a preferred embodiment, the refining solvent contains only methanol and isopropanol; however, it is to be understood that it is possible to include other components in the solvent, provided that the solvent provides a pumpable pitch fraction at a temperature at which the solvent refining system pressure (including the recovery system) does not exceed 150 psig, and preferably does not exceed 100 psig. Accordingly, the present invention is directed in one aspect to the use of a solvent consisting essentially of methanol and propanol (in particular, isopropanol), and also includes a solvent which contains components in addition to the methanol and isopropanol, provided that the materials in addition to methanol and propanol are of a character and/or are present in an amount which does not change the basic characteristics of the solvent; i.e., the solvent produces a pumpable pitch fraction at temperatures at which the solvent refining system does not exceed the hereinabove defined pressures.

A wide variety of heavy fractions (residues) may be subjected to solvent refining in accordance with the present invention. As representative examples of such feeds, there may be mentioned feeds derived from petroleum sources, as well as feeds derived from coal sources; for example, coal liquefaction products or coal tars. As representative examples of specific feeds, there may be mentioned crude oil, atmospheric or long residue, vacuum or short residue, various bitumins, pyrolysis tars, shale oil, tars sands oil, etc. The selection of a suitable feed is deemed to be within the scope of those skilled in the art from the teachings herein.

The present invention is particularly directed to removing pitch-like impurities from residues; however, in such solvent refining, it is also possible to remove other impurities, such as sulphur, nitrogen, metallic impurities, etc., in conjunction with the pitch-like impurities. The degree of removal of such other types of impurities is dependent upon conditions employed and the scope of the invention includes removal of such other impurities. Accordingly, the term "solvent refining" as used herein refers to removal of such pitch-like impurities, as well as removal of other impurities.

In addition, the terms "pitch" or "pitch-like" impurities when used herein generally refer to the removal of pitch (which includes both the resin and asphaltene impurities) as well as to the removal of only asphaltene; for example, solvent refining or deasphalting so as to separately recover deasphalted oil, resins, and asphaltene pitch.

The present invention is particularly applicable to solvent refining of residues in equipment designed for an operating pressure of no greater than 100 psig. In particular, solvent refining in accordance with the present invention by use of a refining solvent consisting essentially of methanol and isopropanol is particularly applicable to a solvent refining process operated in a pre-existing crude unit which has been converted to a residue solvent refining unit, as described in co-pending U.S. Application Ser. No. 680,897, filed on Dec. 12, 1984.

BRIEF DESCRIPTION OF THE DRAWING

The invention will be further described with respect to the accompanying drawing, wherein:

The drawing is a simplified schematic flow diagram of a system for refining of a residue employing a refining solvent in accordance with the present invention.

It is to be understood, however, that the scope of the present invention is not to be limited to the embodiment of the drawing.

The present invention will be described with respect to the preferred embodiments with particular relationship to a process for deasphalting of residues by use of a deasphalting solvent; however, it is to be understood that the scope of the invention is not limited to such a deasphalting process.

Referring now to FIG. 1 of the drawings, a residue which is to be subjected to solvent refining; in particular, deasphalting, such as a black oil, in line 310 is introduced into a separation zone, schematically generally indicated as 311, along with a deasphalting solvent consisting essentially of methanol and isopropanol in line 312.

Although the deasphalting solvent is shown as being introduced into the separating zone 311 independently of the feed in line 310, it is to be understood that the solvent may be pre-mixed with the feed.

The separating zone 311 functions to remove a pitch-like impurity from the feed and provide a heavy fraction comprised of deasphalted solvent and pitch, and a lighter fraction comprised of deasphalted oil and deasphalting solvent.

The separating zone 311 may include a single stage settler, and in accordance with a preferred embodiment, the separator 311 is a desalter of a pre-existing crude unit, which has been converted to a single stage settler. Alternatively, the separator 311 may be an existing desalter or desalters or new equipment which has been suitably converted to permit stagewise contacting of the residue and solvent. As a further alternative, the residue feed and deasphalting solvent may be contacted in a vertical multi-stage countercurrent contactor, such as a baffle type extractor or a rotating disc contactor.

The separating zone 311 is operated at conditions as previously described.

A lighter fraction comprised of deasphalting solvent and deasphalted oil is withdrawn from separator 311 through line 313 and preheated in a preheating section, schematically generally indicated as 315, through line 316.

Similarly, the heavy fraction, comprised of a pitch-like residue and deasphalting solvent, is withdrawn from separation zone 311 through line 317, and such heavy fraction is heated in a preheating zone 318 prior to being introduced into the combination tower 315 through line 319.

Tbe preheating sections 314 and 318 may be formed from any one of a wide variety of heat exchangers so as to obtain maximum heat recovery; however, in accordance with a preferred embodiment, the heat exchangers present in a crude unit are employed in a manner so as to accomplish preheating of the light and heavy fraction, as well as to maximize heat recovery. For example, it may be possible to employ an existing preflash drum of the crude unit and/or existing fired heaters, and if only one heater exists, it may be possible to modify such heater so as to employ the heater for preheating both the heavy and light fraction. Alternatively, new heat exchange equipment may be added.

The combination tower 315 is divided into a first zone or section 321 for separating deasphalted oil from deasphalting solvent, and a second zone or section 322 for separating deasphalting solvent from a pitch-like residue.

The combination tower 315 may be a new piece of equipment or in accordance with a preferred embodiment, the combination tower 315 is a modification of the crude distillation tower employed in a crude unit. Thus, for example, section 321 may be formed by modification of a portion of the existing tower internals to accommodate either a single, double or triple effect flash recovery system, with the resulting vapors being removed from the tower for solvent condensing and stripping gas recycle. Alternatively, the existing tower internals can be modified to accommodate a single flash stage in conjunction with a solvent condensing zone (internally accomplished by conventional pump around heat removal techniques). In addition, one or more of the existing side stripping towers can be suitably modified for the removal of residual solvent from deasphalted oil by use of a stripping gas.

The second section or zone 322 for separating deasphalting solvent from pitch may be formed by modifying existing tower internals so as to accommodate a single flash stage with the resulting vapors being removed from the tower for solvent condensing and stripping gas recycle. Alternatively, existing tower internals can be modified to provide a single flash stage, with the resulting vapors being introduced into the solvent condensing zone of the first zone or stage 321. In both such embodiments, it is preferred to employ a stripping gas for removal of residual solvent from the pitch.

As a further alternative, a new flash drum can be added in parallel with the second zone or section 322 so as to provide additional pitch-solvent separation capacity up to the limit of other existing equipment.

As should be apparent, however, it is possible to provide a new combination tower, rather than using pre-existing equipment.

A pitch is withdrawn from the lower section 322 through line 325, and the solvent which is separated from the pitch is withdrawn from section 322 through line 326.

Deasphalted oil, which is essentially free of deasphalting solvent, is withdrawn from section 321 through line 327, and deasphalting solvent is withdrawn from section 321 through line 328.

The separated deasphalting solvent in lines 326 and 328 are combined in line 329 for introduction into a solvent condensing zone, schematically generally indicated as 331. It is possible to employ equipment existing in a crude unit for effecting such solvent condensation, or in the alternative, a new condensing section may be employed. Although it is possible to effect condensing at elevated pressures, in accordance with the preferred embodiment, condensing is accomplished at pressures no greater than those which exist in the combination tower; i.e., a pressure no greater than about 100 psig. Thus, in accordance with the preferred embodiment, the solvent is condensed without employing external compression.

The external condensing can be accomplished by heat exchange against process, air and/or water. It is also possible to employ some internal condensing by use of external pump around (circulating solvent reflux) and heat exchange against process air and/or water.

Condensed solvent is withdrawn from the solvent condensing section 331 through line 312 for use in deasphalting, as hereinabove described.

Although the present invention has been described with respect to a deasphalting process wherein the deasphalting solvent is employed in a specific type of system, it is to be understood that the deasphalting or solvent refining in accordance with the present invention may be accomplished in other types of systems. Thus, for example, conventional deasphalting equipment may be employed for accomplishing deasphalting with a solvent containing a combination of propanol and methanol.

The invention will be further described with respect to the following examples; however, the scope of the invention is not to be limited thereby.

EXAMPLE

1. The deasphalter was a vertical metallic cylinder with a conical bottom. It was provided with a heating jacket, a bottom valve for draining the asphalt and a number of valves were placed at 2 inch intervals along the generatrix for draining the oil phase.

2. Deasphalting was performed in conditions which are known to simulate to a large extent continuous counter-current contacting.

3. For performing a run, resid and solvent of the desired composition were introduced in the deasphalter and heated to the prescribed temperature under mixing (shaking). After settling 30 minutes at the same temperature, the oil phase was drained. Another portion of solvent (equal in weight to the oil phase just removed) was added to the asphalt phase. Following a 15 minute mixing period at the prescribed temperature, settling was performed (30 min.) and the oil phase was drained. A third portion of solvent was added and one proceeded as above. The oil phase and asphalt phase were separated. The solvent was then vaporized from the asphalt and from the combined oil fractions.

4. The results of Table 1 are obtained when treating as above an Arabian heavy vacuum residue having the properties listed in Table 2.

TABLE 1

| Run No. | 1 | 2 | 3 | 4 |
|---|---|---|---|---|
| MeOH Conc. in solvent (wt. %) | 20 | 20 | 40 | 20 |
| Solvent/feed (wt./wt.) | 2.5 | 2.5 | 2.5 | 1.0 |
| Temperature (°F.) | | | | |
| 1st Treatment | 260 | 280 | 280 | 280 |
| 2nd Treatment | 280 | 280 | 280 | 280 |
| 3rd Treatment | 300 | 280 | 280 | 280 |
| Deasphalted Oil | | | | |
| Yield (wt. %) | 54.0 | 57.5 | 39.5 | 60.6 |
| Heptane Insolubles (%) | 0.6 | 0.8 | 0.8 | 4.8 |
| Ramsbottom Carbon | 7.0 | 8.2 | 6.3 | 11.8 |
| Viscosity (SUS at 210° F.) | 614 | 695 | 475 | 1340 |
| Metals (ppm) | | | | |
| Nickel | 10 | 8 | 5 | 21 |
| Vanadium | 40 | 44 | 48 | 67 |
| Asphalt | | | | |
| Softening Point (Ring & Ball, °F.) | 234 | 250 | 189 | 226 |
| Metals (ppm) | | | | |
| Nickel | 110 | 98 | 71 | 90 |
| Vanadium | 299 | 293 | 215 | 246 |

TABLE 2

| Properties of Arabian Heavy Residue Feed | |
|---|---|
| Heptane Insoluble (%) | 13.0% |
| Ramsbottom Carbon (%) | 20.0% |
| Viscosity (SUS at 210° F.) | 1500 |
| Metals (ppm) | |
| Nickel | 44 |
| Vanadium | 141 |

In comparing Runs 2 and 3, an increase in the quantity of methanol in the solvent (Run 3) produces a lower yield of deasphalted oil, a softer pitch and a higher quality of deasphalted oil (lower metal content and lower Ramsbottom Carbon). The use of lower solvent to feed ratios (Run 4) results in an increase in deasphalted oil yield; however, the oil is of poorer quality (higher metal and Ramsbottom Carbon content). Thus, by proceeding in accordance with the invention, it is possible to vary the quality and yield of deasphalted oil, as well as the properties of the pitch, while maintaining operation at lower system operating temperatures and pressures.

In addition, by proceeding in accordance with the present invention, it is possible to achieve a high yield of deasphalted oil of high quality, while maintaining low operating pressures and temperatures and a flowable pitch fraction. Thus, for example, it is possible to provide a refined oil in yields in excess of fifty percent. It has been found that, by proceeding in accordance with the invention, it is possible to provide yields and quality of refined oil which are at least comparable to those produced with a paraffinic hydrocarbon solvent, while achieving the advantages which result from a low pressure operation.

Numerous modifications and variations of the present invention are possible in light of the above teachings and, therefore, within the scope of the appended claims, the invention may be practiced otherwise than as particularly described.

What is claimed is:

1. A process for solvent refining of a residual oil, comprising: solvent refining the residual oil with a refining solvent to produce a refined oil and a pitch fraction, said refining solvent being a solvent which produces a pumpable pitch fraction at a temperature at which the solvent refining pressure does not exceed 150 psig, said refining solvent comprising methanol and a propanol.

2. The process of claim 1 wherein the ratio of methanol to propanol is from 1:10 to 1:1.

3. The process of claim 2 wherein the solvent refining is effected at a pressure of no greater than 100 psig.

4. The process of claim 3 wherein the solvent refining is effected with a solvent to residual oil feed ratio of at least 1:1 and no greater than 7:1.

5. The process of claim 1 wherein the residual oil feed is derived from petroleum.

6. The process of claim 1 wherein the propanol is isopropanol.

7. The process of claim 6 wherein the ratio of methanol to isopropanol is from 1:10 to 1:1.

8. The process of claim 7 wherein the solvent refining is effected at a pressure of no greater than 100 psig.

9. The process of claim 7 wherein the residual oil feed is derived from petroleum.

10. A process for solvent refining a residual oil, comprising:

solvent refining a residual oil with a refining solvent to produce a refined oil and a pumpable pitch fraction, said refining solvent consisting essentially of methanol and isopropanol.

11. The process of claim 10 wherein the solvent refining is effected at a pressure which does not exceed 100 psig.

12. The process of claim 11 wherein the ratio of methanol to isopropanol is from 1:10 to 1:1.

13. The process of claim 12 wherein the solvent refining effected with a solvent to residual oil feed ratio of at least 1:1 and no greater than 7:1.

14. The process of claim 13 wherein the residual oil feed is derived from petroleum.

* * * * *